United States Patent [19]

Suzuki et al.

[11] Patent Number: 4,495,971

[45] Date of Patent: Jan. 29, 1985

[54] WEFT INSERTING DEVICE FOR A JET LOOM

[75] Inventors: Hajime Suzuki, Anjo; Masao Shiraki, Toyoda, both of Japan

[73] Assignee: Seisakusho Kabushiki Kaisha Toyoda Jidoshokki, Kariya, Japan

[21] Appl. No.: 521,109

[22] Filed: Aug. 8, 1983

[30] Foreign Application Priority Data

Aug. 27, 1982 [JP] Japan ..... 57-149738

[51] Int. Cl.[3] ..... D03D 47/30

[52] U.S. Cl. ..... 139/435

[58] Field of Search ..... 139/435, 453

[56] References Cited

U.S. PATENT DOCUMENTS 4,178,971 12/1979 Malasek ..... 139/435

4,385,649 5/1983 Sevcik ..... 139/435

FOREIGN PATENT DOCUMENTS 2716275 10/1978 Fed. Rep. of Germany ..... 139/453

*Primary Examiner*—Henry S. Jaudon

*Attorney, Agent, or Firm*—Brooks, Haidt, Haffner & Delahunty

[57] ABSTRACT

In the weft inserting device of the invention, a pair of main nozzles are supported by a change lever and the motion of a cam lever operatively linked with movable loom parts for reciprocation thereby is transmitted to said change lever. The timing of motion transmission and interruption is controlled by a timing control unit. According to a preferred embodiment, the control unit is a microcomputer and the timing setting can be changed by changing the weft yarn selection program stored in the microcomputer.

4 Claims, 7 Drawing Figures

WEFT INSERTING DEVICE FOR A JET LOOM

BACKGROUND AND OBJECT OF THE INVENTION

This invention relates to a weft inserting device for a jet loom of the type in which a plurality of main nozzles adapted for inserting weft yarns are respectively associated with the same plurality of supply units supplying said weft yarns. It is the object of the present invention to provide a weft inserting device for a jet loom, according to which a desired one of the main nozzles may be placed at the proper timing in readiness for weft insertion in accordance with a preset weft yarn selecting program.

SUMMARY OF THE INVENTION

With the above object in view, according to the weft inserting device of the present invention, reciprocating motion of a driving member of the jet loom is transmitted to a main nozzle change lever in accordance with a weft yarn selection program. According to a preferred embodiment, the driving member is a cam lever that is swung in reciprocation with rotation of the cam plate. The swinging movement of the cam lever is transmitted to the change lever carrying a pair of main nozzles in accordance with preset weft yarn selecting program.

According to the present invention, desired ones of the main nozzles may be used selectively and in different ways by properly formulating the program and without the necessity of changing mechanical design.

BRIEF DESCRIPTION OF THE DRAWINGS

This invention will become more readily apparent from the following description of preferred embodiments shown, by way of example only, in the accompanying drawings, in which.

DESCRIPTION OF THE PREFERRED EMBODIMENTS

Figure 1:
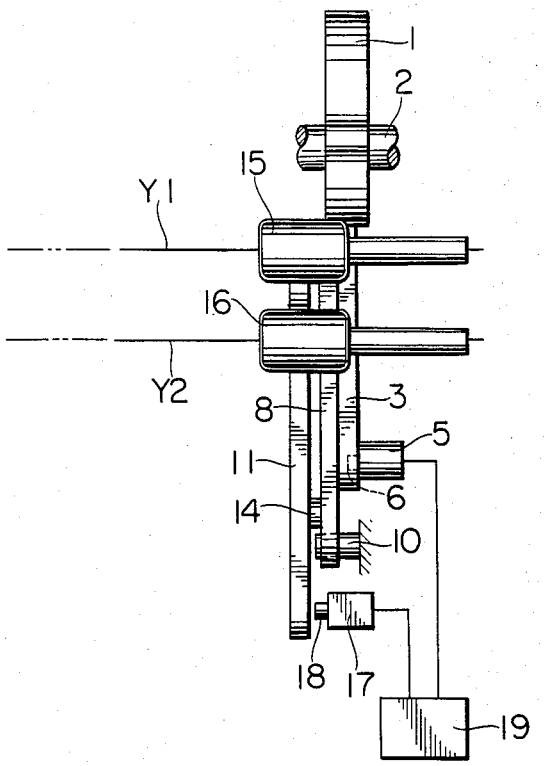
FIG. 1 is a diagrammatic plan view showing a preferred embodiment of the present invention.

FIGS. 1 to 6 illustrate an embodiment of the present invention when applied to a weft inserting device mounted to a frame side of a loom. The numeral 1 designates a cam plate secured to a driving shaft 2 and making a half revolution per each revolution of movable loom parts, not shown. The numeral 3 designates a cam lever or driving member adapted for making a reciprocating swinging motion about pin 4 with rotation of cam plate 1. The cam lever 3 has a portion 3*a* mounting a first solenoid 5 and a latch rod 6 projecting from the surface of the lever portion 3*a* upon energization of the solenoid 5. The cam lever 3 also has another portion 3*b* mounting a cam follower 3*c* which is perpetually urged by a spring 7 clockwise in FIG. 2 and into abutting contact with the cam surface of the cam plate 1. The numeral 8 designates a transmission lever mounted for rotation about pin 4 and urged by a spring 9 to rotate clockwise so that it may be engaged at the lower edge thereof with the latch rod 6. The numeral 10 desigates a stopper of the lever 3.

Figure 2:
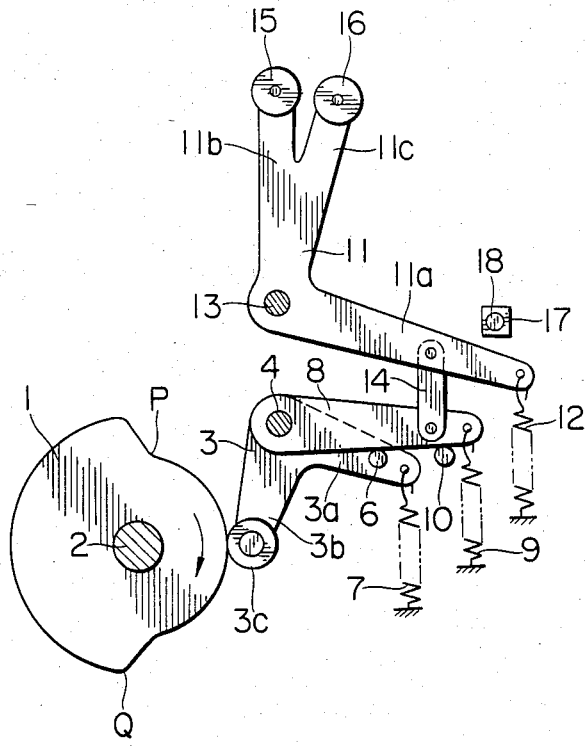
FIGS. 2 through 5 are diagrammatic side views for explaining the operation of the embodiment shown in FIG. 1.
Figure 4:
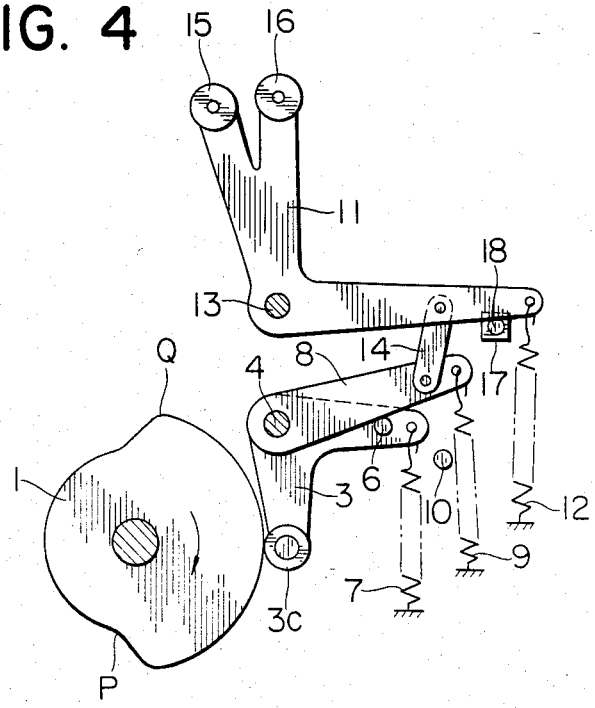

The numeral 11 designates a change lever or a main nozzle supporting member mounted for swinging about a pin 13 and in the neighborhood of the weft inserting position and biased by a spring 12 to rotate clockwise in FIG. 2. This change lever 11 has a first lever portion 11*a* connected by a connecting bar 14 to the transmission lever 8, a second lever portion 11*b* mounting a first main nozzle 15 adapted for inserting weft yarn Y1 supplied from a weft yarn supply unit, not shown, and a second lever portion 11*c* mounting a second main nozzle 16 adapted for inserting weft yarn Y2 supplied from another weft yarn supply, also not shown. The numeral 17 designates a second solenoid adapted to be energized when the second main nozzle 16 has been shifted to the weft inserting position as shown in FIG. 4. With energization of the second solenoid 17, a holding rod 18 operatively associated therewith is protruded to a position engageable with the lower edge of the first lever portion 11*a*.

The numeral 19 designates a control unit, such as microcomputer, for supplying command signals the solenoids 5, 17 in accordance with a weft selection program.

It should be noted that fluid supply valve means, not shown, for controlling the fluid supplied to the first and second main nozzles 15, 16 are operated responsive to the movement of the holding rod 18 in such a manner that the fluid is supplied to the second main nozzle 16 or to the first main nozzle 15 depending on whether the holding rod 18 has or has not been projected into the position engaging with the lower edge of the first lever portion 11*a*.

Figure 6:
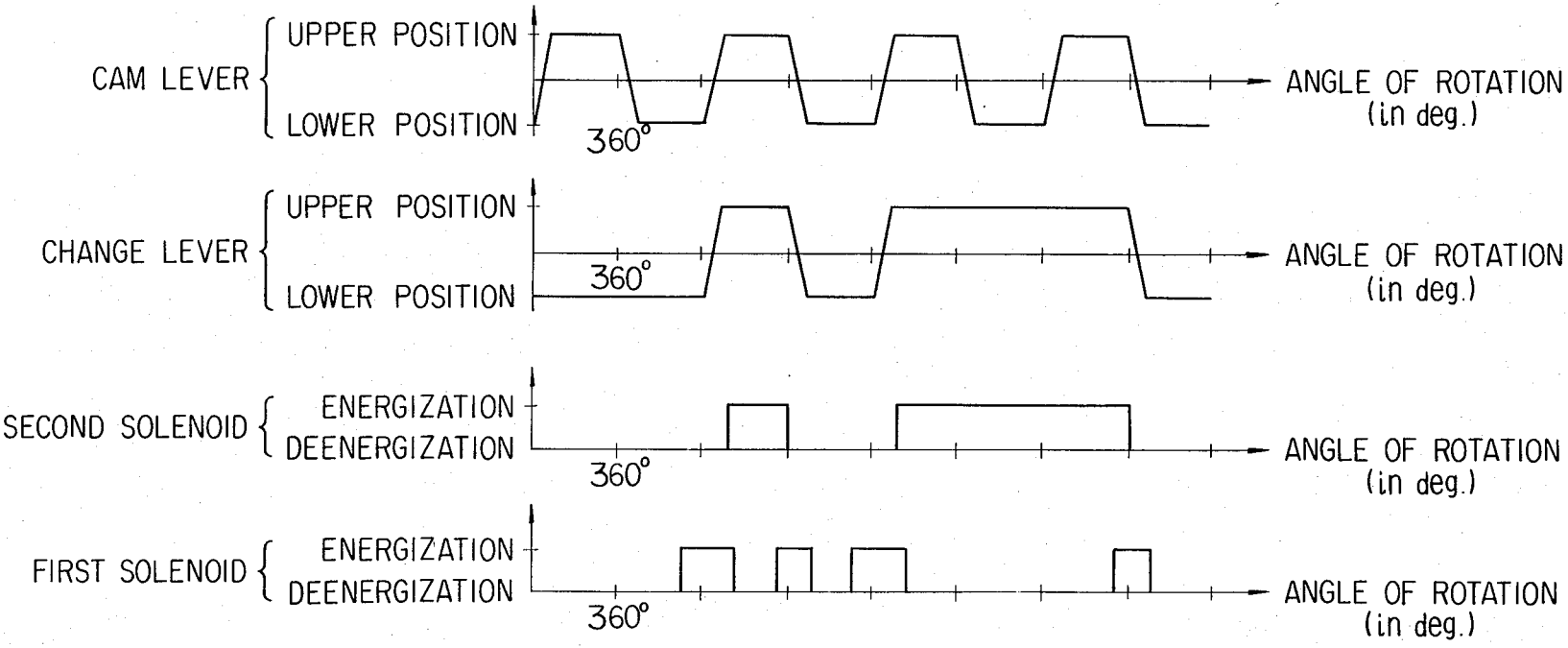
FIG. 6 is a chart showing the weft yarn selecting program.

The operation of the embodiment described above is now described by referring to a weft selecting program shown as an example in FIG. 6.

Figure 3:
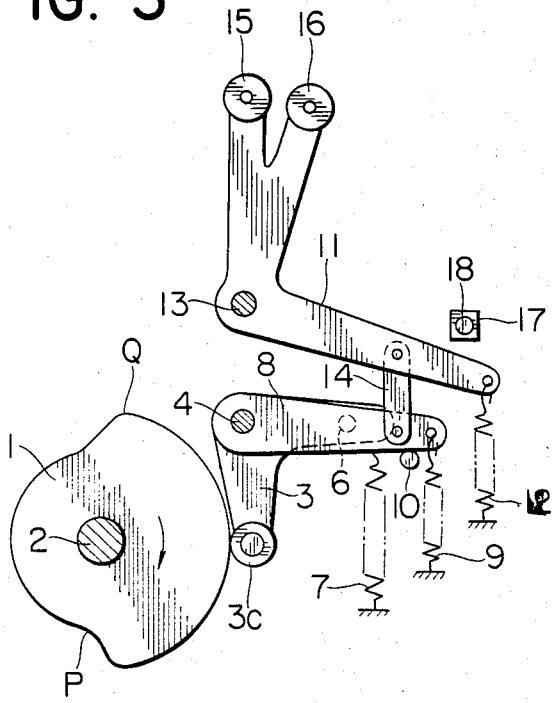

When the cam follower 3*c* abuts on a lesser diameter zone of cam plate 1, and the transmission lever 8 is latched by stopper 10, the first main nozzle 15 is held stationarily at the weft inserting position. When the cam follower 3*c* has shifted to the larger diameter zone of the cam plate 1 with rotation of cam plate 1, the cam lever 3 is rotated counterclockwise in FIG. 2 against the urging force of the spring 7. At this time, the first solenoid 5 is deenergized as shown in FIG. 6 and the latching rod 6 is not projected from the lever portion 3*a*. Thus, as shown in FIG. 3, while the transmission lever 8 is latched by the stopper 10, and the first main nozzle 15 is held at the weft yarn inserting position, only the cam lever 3 is rotated. During the time that the cam follower 3*c* travels from a terminal point P of the lesser diameter zone to a terminal point Q of the larger diameter zone of the cam plate 1, that is, during one complete revolution of the movable parts of the loom or one half revolution of the cam plate 1, a length of weft yarn Y1 is impelled from the first main nozzle 15 to complete a first weft inserting operation.

Next, as the cam plate 1 performs the next one half revolution, and the cam follower 3*c* travels from the terminal point Q of the larger diameter zone to the terminal point P of the lesser diameter zone, the cam lever 3 is returned to its former position, and a next length of weft yarn Y1 is impelled from the first main nozzle 15 to complete a second weft inserting operation. After termination of the second weft inserting operation, a command signal is issued by the control unit 19 in accordance with the weft yarn selecting program so that the first solenoid 5 is energized for projecting the latching rod 6 to the position engageable with the transmission lever 8. As the cam plate 1 is rotated further and the cam follower 3*c* has shifted from the terminal point P of the lesser diameter zone to the larger diameter zone, cam lever 3 is rotated counterclockwise in FIG. 4. At this time, the transmission lever 8 and the change lever 11, now engaged by the latch rod 6, are rotated counterclockwise with the pins 4, 13 as center, respectively, against the urging force of the springs 9, 12. The second main nozzle 16 is now at the weft inserting position in place of the first main nozzle 15.

At this time, the second solenoid 17 is energized by an operational command from the control unit 19 so that the holding rod 18 is protruded into a position engaging with the change lever 11. An instant later, the first solenoid 5 is deenergized so that the latching rod 6 is withdrawn to a position unengageable with the transission lever 8. As the cam follower 3*c* travels to the terminal point Q of the large diameter zone, a length of weft yarn Y2 is impelled from the second main nozzle 16 to perform a third weft inserting operation. After termination of this third weft inserting operation, the first solenoid 5 is energized under the operational command from the control unit 19 so that the latching rod 6 is protruded into a position to engage with the transmission lever 8. An instant later, that is, as the cam follower 3*c* abuts on the terminal point Q of the larger diameter zone, the second solenoid 17 is deenergized so that the holding rod 18 is withdrawn to a position unengageable with the change lever 11. At this time, the change lever 11 and the transmission lever 8 are not held by the holding rod 18, but are held by the latching rod 18. As the cam follower 3*c* is moved from the terminal point Q of the larger diameter zone into the lesser diameter zone, the transmission lever 8 is rotated clockwise in FIG. 4 with the pin 4 as center, while the transmission lever 8 and the change lever 11 are also rotated counterclockwise with the pins 4, 13 as center until the transmission lever 8 is latched by stopper 10, with the first main nozzle 15 being now at the weft inserting position in place of the second main nozzle 16. At this time, since the transmission lever 8 is rotated in unison with cam lever 3, the lever 8 is not impinged abruptly on the stopper 10, but may be engaged quietly therewith.

During the time that the cam follower 3*c* is moved to the terminal point P of the lesser diameter zone, the first solenoid 5 is deenergized so that the latching rod 6 is withdrawn to a position enengageable with transmission lever 8. At this time, the next length of weft yarn Y1 is impelled from the first main nozzle 15 to complete fourth weft insertion. After completion of this weft inserting operation, the first solenoid 5 is energized so that the latching rod 6 is protruded to a position engageable with the transmission lever 8. As the cam follower 3*c* has shifted from the terminal point P of the lesser diameter zone to the larger diameter zone, levers 3, 8 and 11 are rotated counter-clockwise about respective pin 4, 13, as shown in FIG. 4, with the second main nozzle 6 being now at the weft inserting position in place of the first main nozzle 5.

Figure 5:
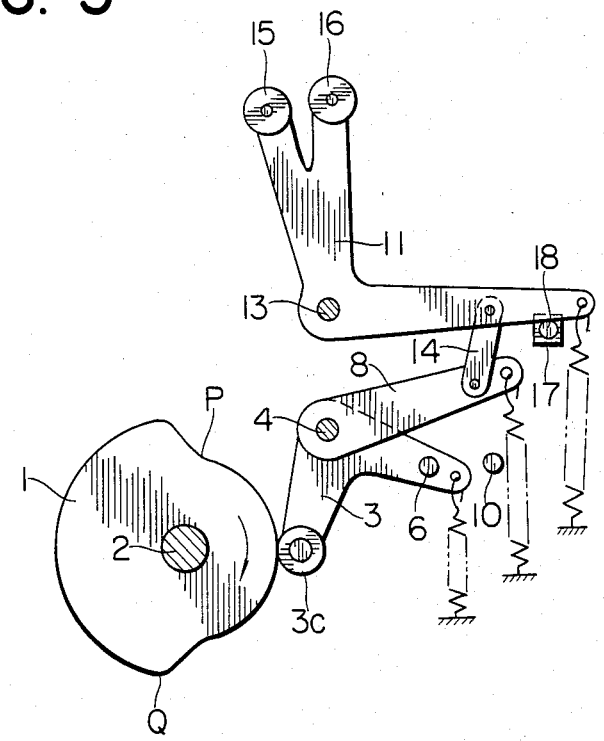

At this time, the second solenoid 17 is energized so that the holding rod 18 is protruded to a position engageable with change lever 11. An instant later, the first solenoid 5 is deenergized so that the latching rod 6 is withdrawn to a position unengageable with transmission lever 8. Thereafter, as the cam plate 1 performs one and a half revolution, that is, as the movable parts of the loom perform approximately three revolutions, the holding rod 18 is kept in the projected position as shown in FIG. 5 so that the second main nozzle 16 is also kept in the weft inserting position. During this time, three successive lengths of weft yarn Y2 are impelled from the second main nozzle 16 to complete fifth, sixth and seventh weft inserting operations. After termination of the seventh weft inserting operation, first solenoid 5 is energized for projecting the latching rod 6 while the second solenoid 17 is deenergized for receding the holding rod 18 to a position unengageable with the change lever 11. As the cam follower 3*c* has shifted from the larger diameter zone to the lesser diameter zone, transmission lever 8 is engaged quietly with stopper 10. The first main nozzle 15 is now at the weft inserting position in place of second main nozzle 16.

From the foregoing, it will be apparent that, since the swinging reciprocal movement of the cam lever 3 caused by rotation of the cam plate 1 is transmitted to the change lever 11 carrying the main nozzles 15, 16 in a manner determined by the weft yarn selection program, the sequence or pattern of using the main nozzles 15, 16 for inserting the weft yarn may be changed as desired by properly changing the control program and without the necessity of changing mechanical parts.

It should be noted that the present invention is not limited to the foregoing arrangement, but comprises a number of modifications. For instance, the following changes can be made within the scope of the present invention.

(a) The first solenoid 5 and the latching rod 6 in the preceding embodiment may be provided to the transmission lever 8 so that the latching rod 6 may be projected into a position engaging with cam lever 3.

(b) The transmission lever 8 and the connecting bar 14 in the preceding embodiment may be dispensed with provided that the latching rod 8 is directly engaged with the change lever 11.

Figure 7:
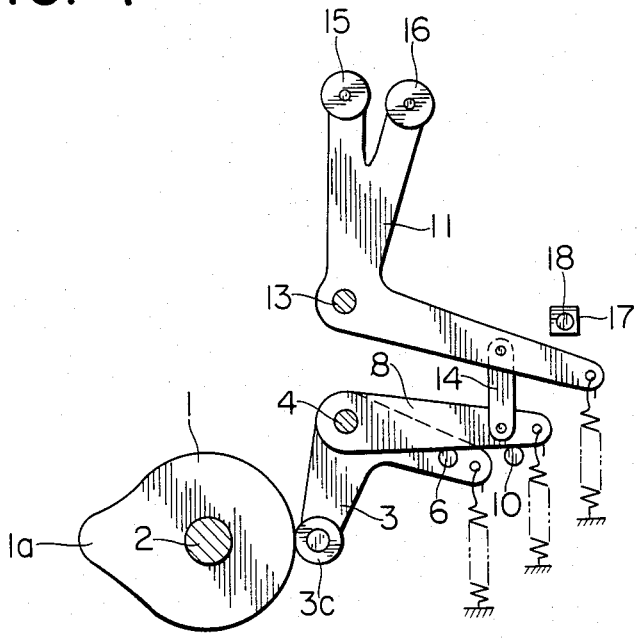
FIG. 7 is a diagrammatic side elevation showing a modification of the present invention.

(c) The cam plate 1 may be changed in profile as shown in FIG. 7 and rotated once per each revolution of the movable loom parts. In this case, the cam follower 3*c* is abutted with the larger diameter zone 1*a* of the cam plate 1 slightly before start of the weft inserting operation.

(d) The change lever 11 may be provided with three or more main nozzles and the number of the latch rods 6 and holding rods 18 increased depending on the number of the main nozzles. In this case, the mounting positions of the supplemented latching and holding rods 6, 18 need be selected depending on the distances traversed by the respective main nozzles when moved towards the weft inserting position.

(e) A plurality of change levers each fitted with one main nozzle or two or more main nozzles are provided and each said change lever is operatively connected to a cam plate.

(f) The present invention may be embodied in a weft inserting device provided to a sley, not shown.

From the foregoing, it will be apparent that the arrangement according to the present invention provides an extremely useful and effective weft inserting device for a jet loom by means of which the reciprocal movement of the driving member may be transmitted to the main nozzle change lever in accordance with the weft yarn selection program so that the main nozzles may be placed in readiness for inserting weft yarn at the proper timing and sequence as determined by said selection program.

What is claimed is:

1. A weft inserting device for a jet loom, comprising:

a main nozzle supporting member carrying a plurality of juxtaposed main nozzles adapted for inserting weft yarns supplied from a plurality of weft yarn suppy means, said supporting member being movably mounted in the neighborhood of the weft inserting position for selectively setting the main nozzles at the weft inserting position;

a driving member operatively linked with movable parts of the loom and thereby driven continually and reciprocably;

electrically actuated means for operatively releasably connecting said driving member and said main nozzle supporting member;

means for holding a predetermined one of said main nozzles in the weft inserting position when said one of said main nozzles is placed in such position; and means for controlling the connecting timing of said connecting means and the operating timing of said holding means.

2. The weft inserting device as claimed in claim 1, wherein said main nozzle supporting member is a change lever swung within a predetermined extent and said driving member is a cam lever reciprocated by a cam which is operatively connected to and rotated in unison with the movable loom parts.

3. The weft inserting device as claimed in claim 2, wherein said connecting means comprises a transmission lever swingably mounted in the vicinity of said cam lever and operatively connected with said change lever, a latching rod mounted to one of said cam lever and transmission lever for protruding into and out of a position engaging with the other of said cam lever and transmission lever, and an electromagnetically operated solenoid for protruding said latching rod.

4. The weft inserting device as claimed in claim 2, wherein said holding means comprises a holding rod protruded into and out of the travel path of said change lever and an electromagnetically operated solenoid for protruding said holding rod.

* * * * *